US010562094B2

(12) United States Patent
Hiraga

(10) Patent No.: US 10,562,094 B2
(45) Date of Patent: Feb. 18, 2020

(54) ANNULAR WEIR

(71) Applicants: NISSHIN STEEL CO., LTD., Tokyo (JP); KROSAKIHARIMA CORPORATION, Fukuoka (JP)

(72) Inventor: Yutaka Hiraga, Kure (JP)

(73) Assignees: NIPPON STEEL NISSHIN CO., LTD., Tokyo (JP); KROSAKIHARIMA CORPORATION, Fukuoka (JP)

( * ) Notice: Subject to any disclaimer, the term of this patent is extended or adjusted under 35 U.S.C. 154(b) by 100 days.

(21) Appl. No.: 15/878,685

(22) Filed: Jan. 24, 2018

(65) Prior Publication Data

US 2018/0147624 A1 May 31, 2018

Related U.S. Application Data

(63) Continuation of application No. PCT/JP2016/073467, filed on Aug. 9, 2016.

(30) Foreign Application Priority Data

Aug. 17, 2015 (JP) ..... 2015-160518
Aug. 17, 2015 (JP) ..... 2015-160520

(51) Int. Cl.
*B22D 11/18* (2006.01)
*B22D 11/118* (2006.01)

(52) U.S. Cl.
CPC ..... *B22D 11/118* (2013.01)

(58) Field of Classification Search
CPC ..... B22D 11/118; B22D 41/003
(Continued)

(56) References Cited

U.S. PATENT DOCUMENTS 5,518,153 A 5/1996 Zacharias et al.
6,554,167 B1 * 4/2003 Barrett ..... B22D 41/003 222/594

(Continued)

FOREIGN PATENT DOCUMENTS

CN 1135193 A 11/1996
CN 104338923 A 2/2015

(Continued)

OTHER PUBLICATIONS

Herve et al. , Supplying storing vessel for holding molten metal, particularly steel, (Espacenet machine translation version (NPL) Jun. 1998, 8 pages. (Year: 1998).*

(Continued)

*Primary Examiner* — Scott R Kastler
*Assistant Examiner* — Michael Aboagye
(74) *Attorney, Agent, or Firm* — Robert P. Michal, Esq.; Cater, DeLuca & Farrell LLP

(57) ABSTRACT

An annular weir is fixed at a bottom of a tundish and just under a long nozzle of a ladle in a continuous casting apparatus. The annular weir includes a cavity which has a substantially circular shaped transverse section. The cavity includes: an upper side opening configured to receive a stream of molten metal from an upper side through the long nozzle; an inner protrusion which is annular in shape and which extends toward an inner side from an upper end of an inner wall of the cavity; a first space on an inner side of the inner protrusion; and a second space which communicates with the first space 13*a* and which is on a lower side of the first space.

5 Claims, 5 Drawing Sheets

(58) Field of Classification Search
USPC ..... 222/591, 594; 266/45, 236, 275
See application file for complete search history.

(56) References Cited

U.S. PATENT DOCUMENTS

| | | | | |
|---|---|---|---|---|
| 8,066,935 | B2 | 11/2011 | Drambarean | |
| 2002/0011696 | A1* | 1/2002 | Clark | B22D 41/003 266/275 |
| 2004/0256775 | A1 | 12/2004 | Retsching et al. | |
| 2009/0152308 | A1 | 6/2009 | Drambarean | |

FOREIGN PATENT DOCUMENTS

| | | | | |
|---|---|---|---|---|
| JP | H10-175046 | A | 6/1998 | |
| JP | H10175046 | * | 6/1998 | B22D 11/118 |
| JP | 2836966 | | 10/1998 | |
| JP | 2011167712 | A | 9/2011 | |
| TW | 200414951 | A | 8/2004 | |
| WO | WO-95/13890 | | 5/1995 | |

OTHER PUBLICATIONS

International Search Report issued by the Japanese Patent Office acting as the International Searching Authority in relation to International Application No. JP/PCT2016/073467 dated Dec. 6, 2016 (4 pages) along with English language translation (2 pages).

Written Opinion issued by the Japanese Patent Office acting as the International Searching Authority in relation to International Application No. JP/PCT2016/073467 dated Dec. 6, 2016 (4 pages).

Office Action issued by the Japanese Patent Office in relation to International Application No. JP/PCT2016/073467 (4 pages) along with English language translation of Office Action dated Oct. 18, 2017 (6 pages).

English translation of Second Office Action issued by the Japanese Patent Office in relation to International Application No. JP/PCT2016/073467 dated Dec. 26, 2017 (3 pages).

First Office Action and Search Report issued by the Taiwanese Patent Office in relation to Taiwanese Application No. 105126079 dated Jun. 21, 2019 (5 pages).

* cited by examiner

Fig. 5

| | size (mm) | | | | | Test Results | | |
|---|---|---|---|---|---|---|---|---|
| | D1 | D2 | H | H1 | H2 | bath surface entrainment | molten steel purity | long nozzle erosion |
| Embodiment 1 | 400 | 500 | 200 | 100 | 100 | small | high | none |
| Embodiment 2 | 450 | 550 | 200 | 100 | 100 | small | high | none |
| Embodiment 3 | 400 | 500 | 250 | 150 | 100 | small | high | none |
| Comparative Example 1 | 500 | 600 | 200 | 100 | 100 | middle | middle | none |
| Comparative Example 2 | 300 | 400 | 200 | 100 | 100 | small | low | middle |
| Comparative Example 3 | 400 | 500 | 330 | 180 | 150 | large | high | small |
| Comparative Example 4 | 400 | 440 | 200 | 100 | 100 | middle | middle | large |

tundish bath surface height: 1000mm
long nozzle discharge hole diameter: 95mm

Fig. 6

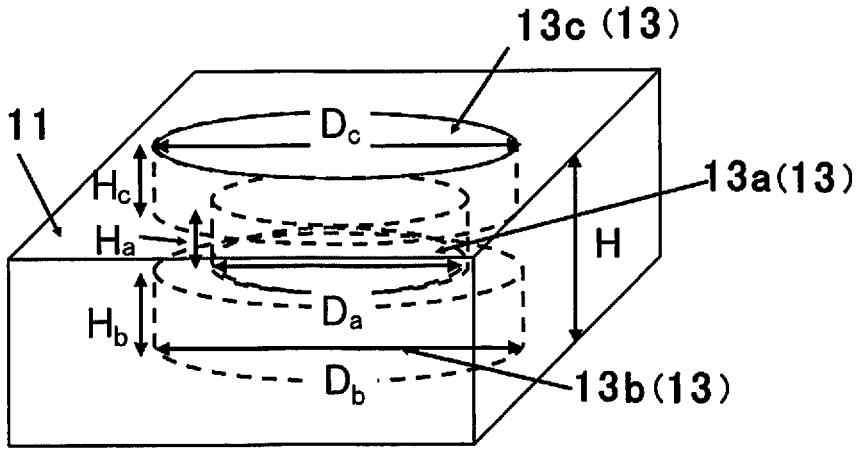

Fig. 7

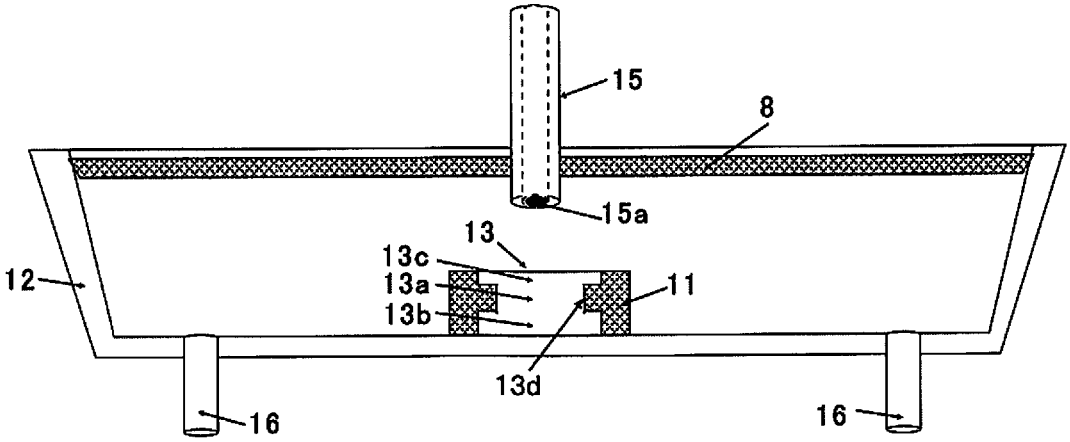

Fig. 8

| | size (mm) | | | | | | | Test Results | | |
|---|---|---|---|---|---|---|---|---|---|---|
| | Dc | Da | Db | H | Hc | Ha | Hb | bath surface entrainment | molten steel purity | long nozzle erosion |
| Embodiment 4 | 500 | 400 | 500 | 250 | 50 | 100 | 100 | small | high | none |
| Embodiment 5 | 550 | 450 | 550 | 250 | 50 | 100 | 100 | small | high | none |
| Embodiment 6 | 500 | 400 | 500 | 200 | 50 | 50 | 100 | small | high | none |
| Comparative Example 5 | 600 | 500 | 600 | 250 | 50 | 100 | 100 | middle | middle | none |
| Comparative Example 6 | 400 | 300 | 400 | 250 | 50 | 100 | 100 | small | low | middle |
| Comparative Example 7 | 500 | 400 | 500 | 330 | 70 | 130 | 130 | large | high | small |
| Comparative Example 8 | 500 | 400 | 440 | 250 | 50 | 100 | 100 | large | high | small |
| Comparaive Example 9 | 440 | 400 | 500 | 250 | 50 | 100 | 100 | large | middle | large |

tundish bath surface height: 1000mm
long nozzle discharge hole diameter: 95mm

ANNULAR WEIR

CROSS REFERENCE TO RELATED APPLICATIONS

This application is a continuation of PCT International Application No. PCT/JP2016/073467, filed Aug. 9, 2016, which claims benefit of Japanese Patent Application No. 2015-160518, filed Aug. 17, 2015 and Japanese Patent Application No. 2015-160520, filed Aug. 17, 2015, the disclosure of each of these applications are expressly incorporated herein by reference in their entireties.

TECHNICAL FIELD

The present invention relates to annular weirs fixed at bottoms of tundishes in continuous casting apparatuses to receive incoming molten metal delivered from upper sides.

BACKGROUND INFORMATION

In order to continuously cast molten metal such as molten steel, the molten steel in ladles is delivered to tundishes for a time and then is delivered to molds.

In order to obtain cast pieces high in purity, sufficiently floating and separating non-metal inclusions in the molten steel delivered to the tundishes from the ladles is essential. In order to sufficiently float and separate the non-metal inclusions, conditions known as short circuiting and high speed flows of the molten steel in the tundishes have to be controlled. The short circuiting refers to the shortest paths molten steel, which is delivered to the tundishes from the ladles, may take to the molds.

Preventive measures against the short circuiting include disposing weirs in the tundishes. The weirs are obstacles against the incoming molten steel, which is delivered to the tundishes from the ladles, to reach immersion nozzles, thereby preventing short circuiting. Also, the weirs lengthen paths the streams of molten steel, which is delivered to the tundishes, take to the molds, thereby promoting the float and separation of the non-metal inclusions in the molten steel.

Unfortunately, however, the weirs do not always control speeds produced by upward streams of the molten steel, which is delivered to the tundishes, which impacts bottoms of the tundishes, and which rebounds upward. High speed upward streams or high speed streams toward side walls of the tundishes posterior to the upward streams may promote slag entrainment on a surface of bath or may shorten time for the streams of the molten steel to pour into the molds. As a result, this configuration does not leave sufficient time for the float and separation of the non-metal inclusions.

In this connection, a weir 4 shown in FIG. 1 has been disclosed (see, for example, Patent document 1).

RELATED ART DOCUMENTS

Patent Documents

Patent document 1: Japanese Patent No. 2836966

FIG. 1 illustrates the weir 4 disposed at a bottom of a tundish 6 in such a manner that an opening 2 of the weir 4 is just under a long nozzle 5 of a ladle. The weir 4 includes refractory material and has a concave shaped opening 3 formed therein, which has a substantially convex shaped cross section. An inner circumferential surface 1 of the concave shaped opening 3 is semicircular in cross section and an upper surface of the concave shaped opening 3 has the opening 2.

As molten metal is directed into the concave shaped opening 3 of the weir 4 from the long nozzle 5, as shown by arrows in FIG. 1, when the molten metal impacts the bottom of the concave shaped opening 3 and rebounds upward, the weir 4 tightens up the upward stream, and the upward stream interferes an incoming stream from the long nozzle 5. This configuration is expected to slow opposing upward and downward streams each other, control high speed flows, and prevent the short circuiting to immersion nozzles 7.

DISCLOSURE OF THE INVENTION

Problems to be Solved by the Invention

Unfortunately, however, the invention of Patent document 1 still has problems such as possibility of slag entrainment on a surface of bath in a tundish 6, and possibility of damages on the long nozzle 5, which includes refractory material. The invention also has rooms for improvement. For example, interference between downward streams from the long nozzles 5 and upward streams which are rebounded may be too weak to slow the upward streams.

Patent document 1 indicates that the weir 4 may have optional shapes, including a rectangular shape in plane shown in FIG. 2. Even with this configuration, the weir 4 does not perform a sufficient effect and may cause harmful effect. Since fluid leans in a direction with the least stress, the upward stream which is rebounded mainly leans toward shorter sides, in other words, in a longitudinal direction of the tundish in case of the weir 4 of FIG. 2 having the rectangular shape. Accordingly, this configuration does not achieve an original object of increasing time it takes for incoming molten metal to reach the immersion nozzles 7 such that impurities naturally float slowly to the top of the bath.

Therefore, an object of the present invention is to provide a weir capable of controlling the high speed flows as well as preventing short circuiting of the molten metal.

Means of Solving the Problems

In order to achieve the above-mentioned object, according to a first aspect of the invention, an annular weir (11) is provided, the annular weir (11) being fixed at a bottom of a tundish and just under a long nozzle (15) of a ladle in a continuous casting apparatus, the annular weir (11) including a cavity (13) which has a substantially circular shaped transverse section, the cavity (13) including: an upper side opening configured to receive a stream of molten metal from an upper side through the long nozzle (15); an inner protrusion (13*d*) which is annular in shape, the inner protrusion (13*d*) extending toward an inner side from an upper end of an inner wall of the cavity (13); a first space (13*a*) on an inner side of the inner protrusion (13*d*); and a second space (13*b*) which communicates with the first space (13*a*), the second space (13*b*) being on a lower side of the first space (13*a*).

In addition, according to a second aspect of the invention, an annular weir (11) is provided, the annular weir (11) being fixed at a bottom of a tundish (12) and just under a long nozzle (15) of a ladle in a continuous casting apparatus, the annular weir (11) including a cavity (13) which has a substantially circular shaped transverse section, the cavity (13) including: an upper side opening configured to receive a stream of molten metal from an upper side through the long nozzle (15); an inner protrusion (13*d*) which is annular in shape, the inner protrusion (13*d*) extending toward an inner side from an inner wall of the cavity (13); a third space (13*c*) on an upper side of the inner protrusion (13*d*); a first space (13*a*) which communicates with the third space (13*c*), the first space (13*a*) being on a lower side of the third space (13*c*) and on an inner side of the inner protrusion (13*d*); and a second space (13*b*) which communicates with the first space (13*a*), the second space (13*b*) being on a lower side of the first space (13*a*).

In addition, according to a third aspect of the present invention, an inside diameter ($D_1$, $D_a$) of the first space (13*a*) is within a range of 4 times to 5 times a diameter of a discharge hole (15*a*) of the long nozzle (15), and an inside diameter ($D_2$, $D_b$) of the second space (13*b*) is within a range of 1.2 times to 1.5 times the inside diameter ($D_1$, $D_a$) of the first space (13*a*).

In addition, according to a fourth aspect of the present invention, height (H) of the annular weir (11) is within a range of ⅙ to ¼ of height of a surface of a bath in operation.

In addition, according to a fifth aspect of the present invention, the cavity (13) is a bore that bores in an upper and lower direction.

In addition, according to a sixth aspect of the present invention, an inside diameter ($D_c$) of the third space (13*c*) is within a range of 1 time to 1.1 times the inside diameter ($D_b$) of the second space (13*b*).

In addition, according to a seventh aspect of the present invention, the inside diameter ($D_c$) of the third space (13*c*) is gradually increased from a lower side toward an upper side.

In addition, according to an eighth aspect of the present invention, an annular weir (11) is provided, the annular weir (11) being fixed at a bottom of a tundish (12) and just under a long nozzle (15) of a ladle in a continuous casting apparatus, the annular weir (11) including a cavity (13) which has a substantially circular shaped transverse section, the cavity (13) including: an upper side opening configured to receive a stream of molten metal from an upper side through the long nozzle (15); a plurality of inner protrusions (13*d*) which are annular in shape, the plurality of inner protrusions (13*d*) extending toward an inner side from an inner wall of the cavity (13); and a plurality of spaces divided by the plurality of inner protrusions (13*d*), the plurality of spaces in an upper and lower direction communicating with each other.

Symbols in parentheses show constituents or items corresponding to the drawings.

According to the present invention, the stream of molten metal, which is directed by the long nozzle into the cavity of the annular weir, impacts the bottom of the tundish or the annular weir, and rebounds upward. This configuration prevents short circuiting of the molten metal to immersion nozzles immersed in a mold.

The inner protrusion tightens up an upward stream and the upward stream interferes a downward stream from the long nozzle. This configuration slows the opposing upward and downward streams each other and increases time for the molten metal to reach the immersion nozzles.

This configuration promotes float and separation of the non-metal inclusions in the molten metal, thereby improving quality of cast products.

Especially, with the configuration that the inside diameter of the first space is within the range of 4 times to 5 times the diameter of the discharge hole of the long nozzle and the inside diameter of the second space is within the range of 1.2 times to 1.5 times the inside diameter of the first space, the upward stream and the downward stream interfere with each other without fail and speed of the molten metal is controlled.

In addition, with the configuration that the height of the annular weir is within the range of ⅙ to ¼ of the height of the surface of the bath in operation, possibility of surface turbulence in the bath caused by the upward stream is low and therefore, slag entrainment on the surface of the bath is minimized.

In addition, with the configuration that the cavity is the bore that bores in the upper and lower direction, the annular weir is simply manufactured at a low cost. The bore does not cause any structural disadvantage for the bottom of the tundish substitutes for a bottom of the annular weir.

It is to be noted that Patent document 1 does not disclose that the inner protrusion is formed, the inside diameter of the first space is within the range of 4 times to 5 times the diameter of the discharge hole of the long nozzle, or the inside diameter of the second space is within the range of 1.2 times to 1.5 times the inside diameter of the first space, as the annular weir of the present invention.

BRIEF DESCRIPTION OF THE DRAWINGS

FIG. 5 is a diagram of results of operation performance with size of the annular weir of FIG. 3 changed;

FIG. 6 is a perspective view of an annular weir according to an embodiment of the present invention;

FIG. 7 is a cross section of the annular weir of FIG. 6 disposed on a tundish; and FIG. 8 is a diagram of results of operation performance with size of the annular weir of FIG. 6 changed.

MODE FOR CARRYING OUT THE INVENTION (Embodiment 1)

Figure 1:
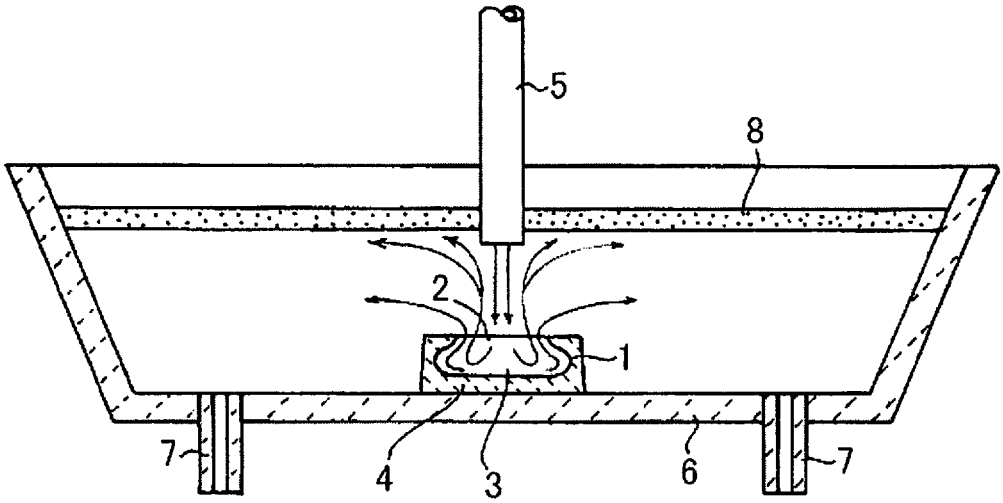
Fig. 1 PRIOR ART
FIG. 1 is a cross section of a weir according to a prior art disposed on a tundish.
Figure 2:
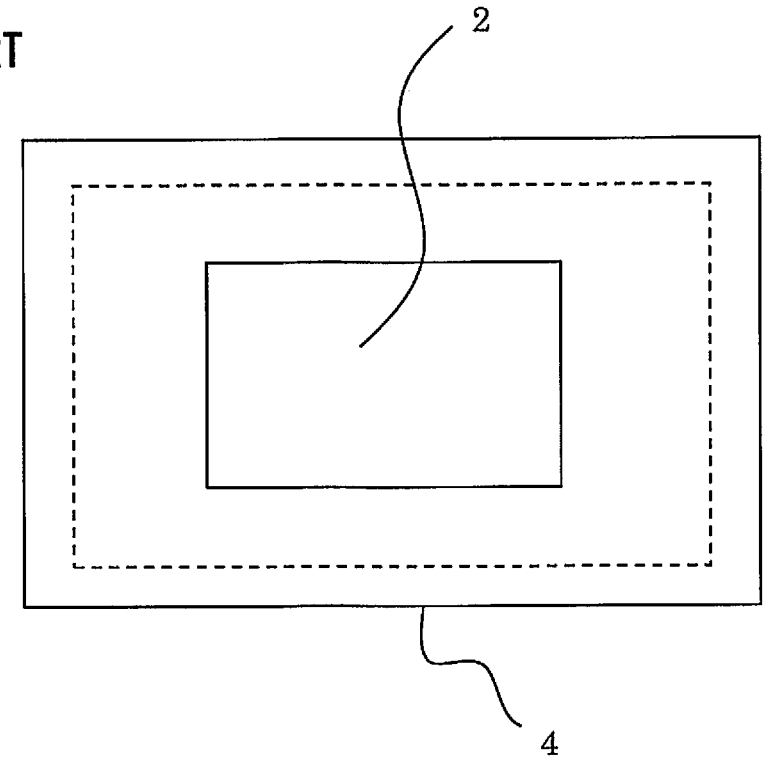
Fig. 2 PRIOR ART
FIG. 2 is an enlarged plan view of the weir of FIG. 1.
Figure 3:
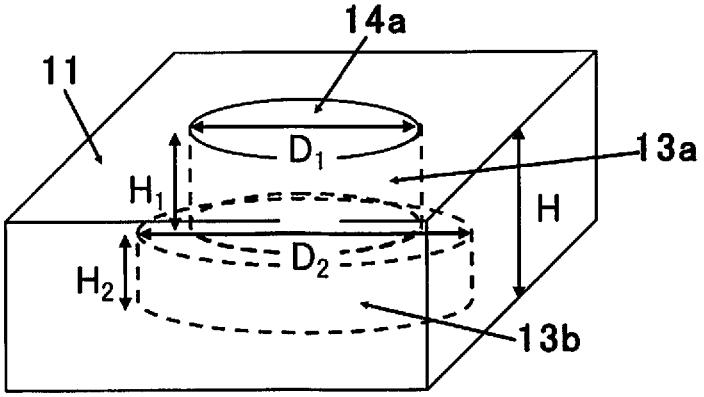
FIG. 3 is a perspective view of an annular weir according to an embodiment of the present invention.
Figure 4:
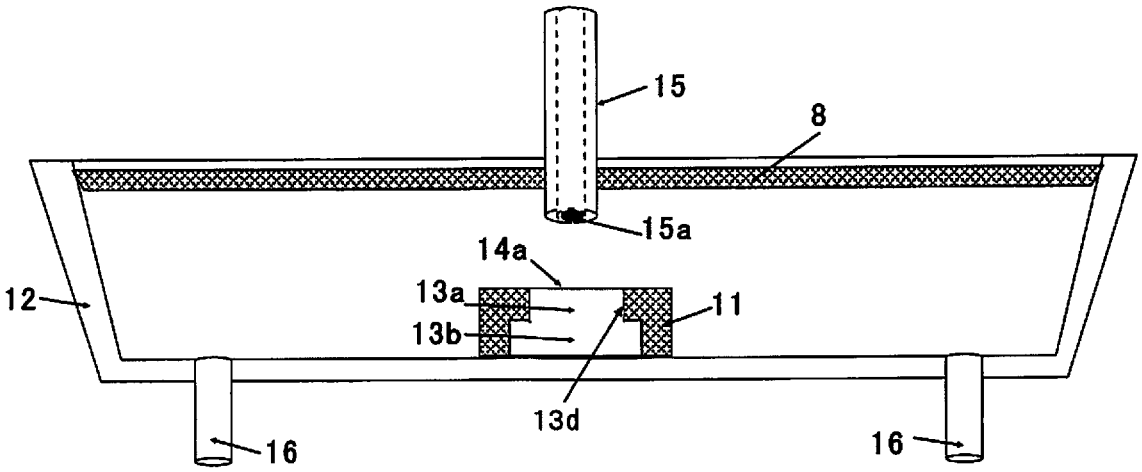
FIG. 4 is a cross section of the annular weir of FIG. 3 disposed on a tundish.

Referring to FIG. 3 to FIG. 5, an annular weir 11 according to an embodiment of the present invention will be described.

The annular weir 11 controls speed of molten metal delivered from a ladle within a tundish 12 in a continuous casting apparatus. The annular weir 11 includes a cavity 13, which has a substantially circular shaped transverse section (horizontal cross section).

FIG. 3 is a perspective view of the annular weir 11 according to the present invention. FIG. 4 is a cross section of the annular weir 11 of FIG. 3 fixed on the tundish 12.

The annular weir 11 includes refractory material and is prismatic in outward appearance. The annular weir 11 has the cavity 13 formed at a center thereof. The cavity 13 is a bore that bores in an upper and lower direction.

An inner protrusion 13*d* is formed on an upper end of an inner wall of the cavity 13. The inner protrusion 13*d* is annular in shape and extends toward an inner side from the upper end.

The cavity 13 includes: a first space 13*a* on an inner side of the inner protrusion 13*d;* and a second space 13*b* which communicates with the first space 13*a* and which is on a lower side of the first space 13*a*. The cavity 13 has a substantially convex-shaped longitudinal section.

The inner wall of the cavity 13 and an end surface of the inner protrusion 13*d* extend vertically. The first space 13*a* and the second space 13*b* are formed on an uneven base with a step therebetween.

An inside diameter $D_1$ of the first space 13*a* is within a range of 4 times to 5 times a diameter of a discharge hole 15*a* of a long nozzle 15. In the present embodiment, $D_1$ of the first space 13*a* is 400 mm, and an inside diameter $D_2$ of the second space 13*b* is 500 mm which is 1.25 times the inside diameter $D_1$ of the first space 13*a*. The diameter of the discharge hole 15*a* of the long nozzle 15 is 95 mm.

Height of a surface of a bath in operation is 1000 mm from a bottom of the tundish 12. Height H of the annular weir 11 is ⅕ (200 mm) of height of the surface of the bath in operation in the tundish 12. Heights H1, H2 of the first space 13*a* and the second space 13*b* meet H1=H2=½H.

As shown in FIG. 4, the annular weir 11 is fixed at the bottom of the tundish 12 in such a manner that the cavity 13 is just under the long nozzle 15 of a ladle not shown. While the cavity 13 does not include a bottom, the bottom of the tundish 12 substitutes for the bottom. The annular weir 11 is fixed by the same ways as ordinary weirs, by mortar for example.

In FIG. 3 and FIG. 4, a body of the annular weir 11 is prismatic. But the outward appearance of the body of the annular weir 11 is not strictly limited. Examples of the outward appearance include a columnar shape in accordance with an inner part of the cavity 13 and a pyramidal trapezoid which spreads upward in accordance with a shape inside the tundish 12.

With this configuration of the annular weir 11, the stream of molten metal, which is directed by the long nozzle 15 into the cavity 13 of the annular weir 11, impacts the bottom of the tundish 12, and rebounds upward. As a result, this configuration prevents short circuiting of the molten metal to immersion nozzles 16 immersed in a mold.

The inner protrusion 13*d* tightens up the upward stream and the upward stream interferes the downward stream from the long nozzle 15. This configuration slows the opposing upward and downward streams each other and increases time for the molten metal to reach the immersion nozzles 16.

In addition, with the configuration that the height H of the annular weir 11 is ⅕ of the height of the surface of the bath in operation, possibility of surface turbulence in the bath caused by the upward stream is low and therefore, slag entrainment on the surface of the bath is minimized.

This configuration promotes float and separation of the non-metal inclusions in the molten metal, thereby improving quality of the cast products.

In addition, above-described conditions prevent erosion on a top end of the long nozzle 15 (see FIG. 5).

In addition, with the configuration that the cavity 13 is the bore that bores in the upper and lower direction, the annular weir 11 is simply manufactured at a low cost. The bore does not cause any structural disadvantage for a bottom of the tundish 12 substitutes for the bottom of the annular weir 11.

(Embodiment 2)

Conditions for Embodiment 2 will be described.

In the present embodiment, the inside diameter $D_1$ of the first space 13*a* was 450 mm and the inside diameter $D_2$ of the second space 13*b* was 550 mm.

The height H of the annular weir 11, the height $H_1$ of the first space 13*a*, and the height $H_2$ of the second space 13*b* remain unchanged from Embodiment 1.

(Embodiment 3)

In Embodiment 3, the inside diameter $D_1$ of the first space 13*a* and the inside diameter $D_2$ of the second space 13*b* remain unchanged from Embodiment 1. The height H of the annular weir 11 was 250 mm, the height $H_1$ of the first space 13*a* was 150 mm, and the height $H_2$ of the second space was 100 mm.

As shown in FIG. 5, in Embodiment 2 and Embodiment 3, entrainment of the surface of the bath was slight, and therefore, resultant molten steel was high in purity. In addition, the long nozzle 15 was not eroded.

The results show that the inside diameter $D_1$ of the first space 13*a* is preferably within the range of 4 times to 5 times the diameter of the discharge hole 15*a* of the long nozzle.

(Comparative Examples 1 to 4)

In Comparative Example 1, the diameter $D_1$ of the first space 13*a* was larger. As a result, as shown in FIG. 5, slag entrainment on the surface of the bath was promoted and the resultant molten steel was slightly inferior to the Embodiment in purity.

In Comparative Example 2, the diameter $D_1$ of the first space 13*a* was smaller. As a result, entrainment of the surface of the bath was not observed, but the resultant molten steel was considerably inferior in purity.

In Comparative Example 3, the height H of the annular weir 11 was ⅓ of the height of the surface of the bath. As a result, the resultant molten steel was equivalent in purity but entrainment of the surface of the bath was considerable, thereby hampering steady operations.

In Comparative Example 4, the diameter $D_2$ of the second space 13*b* was 1.1 times the diameter $D_1$ of the first space 13*a*. As a result, entrainment of the surface of the bath was slightly observed and the erosion on the top end of the long nozzle 15 after casting was so considerable that the long nozzle 15 became ineffective approximately at half number of heating.

(Embodiment 4)

Referring to FIG. 6 to FIG. 8, the annular weir 11 according to another embodiment of the present invention will be described.

The annular weir 11 controls speed of molten metal delivered from the ladle within the tundish 12 in the continuous casting apparatus. The annular weir 11 includes the cavity 13, which has the substantially circular shaped transverse section (horizontal cross section).

FIG. 6 is a perspective view of the annular weir 11 according to the present invention. FIG. 7 is a cross section of the annular weir 11 of FIG. 6 fixed on the tundish 12.

The annular weir 11 includes refractory material and is prismatic in outward appearance. The annular weir 11 has the cavity 13 formed at the center thereof. The cavity 13 is the bore that bores between the upper end and the lower end.

The inner protrusion 13*d* is formed at a substantial center in an upper and lower direction of the inner wall of the cavity 13. The inner protrusion 13*d* is annular in shape and extends toward the inner side from the substantial center.

The cavity 13 includes: a third space 13*c* on an upper side of the inner protrusion 13*d;* the first space 13*a* on the inner side of the inner protrusion 13*d;* and the second space 13*b* which communicates with the first space 13*a* and which is on the lower side of the first space 13*a*.

The inner wall of the cavity 13 and an end surface of the inner protrusion 13*d* extend vertically. The third space 13*c* and the first space 13*a*, and the first space 13*a* and the second space 13*b* are formed on an uneven base with a step therebetween.

An inside diameter $D_a$ of the first space 13*a* is within the range of 4 times to 5 times the diameter of the discharge hole

15*a* of the long nozzle 15. In the present embodiment, $D_a$ of the first space 13*a* is 400 mm, and an inside diameter $D_c$ of the third space 13*c* and an inside diameter $D_b$ of the second space 13*b* are 500 mm, respectively, which is 1.25 times the inside diameter $D_a$ of the first space 13*a*. The diameter of the discharge hole 15*a* of the long nozzle 15 is 95 mm.

The height of the surface of the bath in operation is 1000 mm from the bottom of the tundish 12. The height H of the annular weir 11 is ¼ (250 mm) of the height of the surface of the bath in operation in the tundish 12. Heights $H_c$, $H_a$, $H_b$ of the third space 13*c*, the first space 13*a*, and the second space 13*b* meet $H_c$=⅕ H, $H_a$=$H_b$=⅖ H.

As shown in FIG. 7, the annular weir 11 is fixed at the bottom of the tundish 12 in such a manner that the cavity 13 is just under the long nozzle 15 of the ladle not shown. While the cavity 13 does not include the bottom, the bottom of the tundish 12 substitutes for the bottom. The annular weir 11 is fixed by the same ways as ordinary weirs, by mortar for example.

In FIG. 6 and FIG. 7, the body of the annular weir 11 is prismatic. But the outward appearance of the body of the annular weir 11 is not strictly limited. Examples of the outward appearance include the columnar shape in accordance with the inner part of the cavity 13 and the pyramidal trapezoid which spreads upward in accordance with the shape inside the tundish 12.

With this configuration of the annular weir 11, the stream of molten metal, which is directed by the long nozzle 15 into the cavity 13 of the annular weir 11, impacts the bottom of the tundish 12, and rebounds upward. As a result, this configuration prevents short circuiting of the molten metal to the immersion nozzles 16, immersed in the mold.

The inner protrusion 13*d* tightens up the upward stream and the upward stream interferes the downward stream from the long nozzle 15. This configuration slows the opposing upward and downward streams each other and increases time for the molten metal to reach the immersions nozzles 16.

In addition, with the configuration that the height H of the annular weir 11 is ¼ of the height of the surface of the bath in operation, possibility of surface turbulence in the bath caused by the upward stream is low and therefore, slag entrainment on the surface of the bath is minimized.

This configuration promotes float and separation of the non-metal inclusions in the molten metal, thereby improving quality of the cast products.

In addition, above-described conditions prevent erosion on the top end of the long nozzle 15 (see FIG. 8).

In addition, with the configuration that the cavity 13 is the bore that bores in the upper and lower direction, the annular weir 11 is simply manufactured at the low cost. The bore does not cause any structural disadvantage for the bottom of the tundish 12 substitutes for the bottom of the annular weir 11.

(Embodiment 5)

Conditions for Embodiment 5 will be described.

In the present embodiment, the inside diameter $D_c$ of the third space 13*c* was 550 mm, the inside diameter $D_a$ of the first space 13*a* was 450 mm, and the inside diameter $D_b$ of the second space 13*b* was 550 mm.

The height H of the annular weir 11, the height $H_c$ of the third space 13*c*, the height $H_a$ of the first space 13*a*, and the height $H_b$ of the second space 13*b* remain unchanged from Embodiment 4.

(Embodiment 6)

In Embodiment 6, the inside diameter $D_c$ of the third space 13*c*, the inside diameter $D_a$ of the first space 13*a*, and the inside diameter $D_b$ of the second space 13*b* remain unchanged from Embodiment 4. The height H of the annular weir 11 was 200 mm, the height $H_c$ of the third space 13*c* was 50 mm, the height $H_a$ of the first space 13*a* was 50 mm, and the height $H_b$ of the second space 13*b* was 100 mm.

As shown in FIG. 8, in Embodiment 5 and Embodiment 6, entrainment of the surface of the bath was slight, and therefore, resultant molten steel was high in purity. In addition, the long nozzle 15 was not eroded.

The results show that the inside diameter $D_a$ of the first space 13*a* is preferably within the range of 4 times to 5 times the diameter of the discharge hole 15*a* of the long nozzle.

(Comparative Examples 5 to 9)

In Comparative Example 5, the diameter $D_c$ of the third space 13*a* was larger. As a result, as shown in FIG. 8, the resultant molten steel was slightly inferior to the Embodiment in purity.

In Comparative Example 6, the diameter $D_a$ of the first space 13*a* was smaller. As a result, the resultant molten steel was considerably inferior in purity.

In Comparative Example 7, the height H of the annular weir 11 was ⅓ of the height of the surface of the bath. As a result, the resultant molten steel was equivalent in purity but entrainment of the surface of the bath was considerable, thereby hampering steady operations.

In Comparative Example 8, the diameter $D_b$ of the second space 13*b* was 1.1 times the diameter $D_a$ of the first space 13*a*. As a result, entrainment of the surface of the bath was observed, which was substantially of the same degree as Comparative Example 7.

In Comparative Example 9, the diameter $D_c$ of the third space 13*c* was smaller than the diameter $D_b$ of the second space 13*b*. As a result, entrainment of the surface of the bath was observed, which was substantially of the same degree as Comparative Example 8. Also, erosion on the top end of the long nozzle 15 after casting was so considerable that the long nozzle 15 became ineffective approximately at half number of heating.

In the present embodiment, the inside diameter $D_2$, $D_b$ of the second space 13*b* may be within a range of 1.2 times to 1.5 times the inside diameter $D_1$, $D_a$ of the first space 13*a*.

In addition, the height H of the annular weir 11 may be within a range of ⅙ to ¼ of the height of the surface of the bath.

In addition, the inside diameter $D_c$ of the third space 13*c* may be within a range of 1 time to 1.1 times the inside diameter $D_b$ of the second space 13*b*.

While the cavity 13 of the present embodiment is the bore, shape of the cavity 13 is not strictly limited. That is, the cavity 13 may include a bottom such that the cavity 13 does not bore the annular weir 11.

In addition, the inside diameter of the third space 13*c* may be gradually increased from a lower side toward an upper side. In this configuration, a diameter on a lower end of the third space 13*c* equals to a diameter on an upper end of the first space 13*a*.

In addition, a plurality of inner protrusions 13*d* may be formed in the upper and lower direction. In this configuration, the plurality of inner protrusions 13*d* divide the cavity 13 into more spaces than the singular inner protrusion 13*d*.

DESCRIPTION OF NUMERALS

1 inner circumferential surface
2 opening
3 concave shaped opening
4 weir
5 long nozzle
6 tundish
11 annular weir
12 tundish
13 cavity
13*a* first space
13*b* second space
13*c* third space
13*d* inner protrusion
15 long nozzle
15*a* discharge hole
16 immersion nozzle
$D_1$ inside diameter of first space
$D_2$ inside diameter of second space
$D_a$ inside diameter of first space
$D_b$ inside diameter of second space
$D_c$ inside diameter of third space
H height of annular weir
$H_1$ height of first space
$H_2$ height of second space
$H_a$ height of first space
$H_b$ height of second space
$H_c$ height of third space

The invention claimed is:

1. An annular weir fixed at a bottom of a tundish and under a long nozzle of a ladle in a continuous casting apparatus, the annular weir comprising a cavity which has a substantially circular shaped transverse section, the cavity including:

an upper side opening configured to receive a stream of molten metal from an upper side through said long nozzle;

an inner protrusion which is annular in shape, the inner protrusion extending toward an inner side from an upper end of an inner wall of said cavity;

a first space on an inner side of said inner protrusion; and a second space which communicates with said first space, the second space being on a lower side of said first space, wherein:

an inside diameter of said first space is within a range of 4 times to 5 times a diameter of a discharge hole of said long nozzle, and an inside diameter of said second space is within a range of 1.2 times to 1.5 times the inside diameter of said first space; and a height of said annular weir is within a range of ⅙ to ¼ of a height of a surface of a bath in the tundish during operation.

2. The annular weir as claimed in claim 1, wherein the cavity is a bore that bores in an upper and lower direction.

3. An annular weir fixed at a bottom of a tundish and under a long nozzle of a ladle in a continuous casting apparatus, the annular weir comprising a cavity which has a substantially circular shaped transverse section, the cavity including:

an upper side opening configured to receive a stream of molten metal from an upper side through said long nozzle;

an inner protrusion which is annular in shape, the inner protrusion extending toward an inner side from an inner wall of said cavity;

a third space on an upper side of said inner protrusion;

a first space which communicates with said third space, the first space being on a lower side of said third space and on an inner side of said inner protrusion; and a second space which communicates with said first space, the second space being on a lower side of said first space, wherein:

an inside diameter of said first space is within a range of 4 times to 5 times a diameter of a discharge hole of said long nozzle, and an inside diameter of said second space is within a range of 1.2 times to 1.5 times the inside diameter of said first space; and a height of said annular weir is within a range of ⅙ to ¼ of a height of a surface of a bath in the tundish during operation.

4. The annular weir as claimed in claim 3, wherein an inside diameter of said third space is within a range of 1 time to 1.1 times the inside diameter of said second space.

5. The annular weir as claimed in claim 3, wherein the cavity is a bore that bores in an upper and lower direction.

* * * * *